US005858454A

United States Patent [19]

Kiryu et al.

[11] Patent Number: 5,858,454

[45] **Date of Patent: *Jan. 12, 1999**

[54] OVERCURRENT PROTECTION DEVICE

[75] Inventors: Michiaki Kiryu, Ina; Satoru Kobayashi, Komagane, both of Japan

[73] Assignee: KOA Kabushiki Kaisha, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 774,915

[22] Filed: Dec. 27, 1996

Related U.S. Application Data

[60] Continuation of Ser. No. 410,139, Mar. 23, 1995, abandoned, which is a division of Ser. No. 235,287, Apr. 29, 1994, Pat. No. 5,572,181.

[30] Foreign Application Priority Data

Apr. 30, 1993 [JP] Japan ..... 5-103867

[51] Int. Cl.[6] ..... B05D 5/12

[52] U.S. Cl. ..... 427/118; 427/58; 337/404; 337/415; 337/416

[58] Field of Search ..... 427/58, 96, 118; 337/158, 273, 276, 280, 282, 401, 404, 414, 415, 416

[56] References Cited

U.S. PATENT DOCUMENTS

| | | | |
|---|---|---|---|
| 2,342,320 | 2/1944 | Ziegel | 200/142 |
| 3,810,062 | 5/1974 | Kozacka | 337/161 |
| 4,109,228 | 8/1978 | Wycklendt et al. | 337/276 |
| 4,124,836 | 11/1978 | Wilks | 337/186 |
| 4,709,222 | 11/1987 | Morita et al. | 337/273 |
| 4,873,506 | 10/1989 | Gurevich | 337/290 |
| 4,893,106 | 1/1990 | Goldstein et al. | 337/159 |
| 5,572,181 | 11/1996 | Kiryu et al. | 337/273 |

*Primary Examiner*—Brian K. Talbot
*Attorney, Agent, or Firm*—Morrison Law Firm

[57] ABSTRACT

An overcurrent protection device and a method for the production thereof is provided wherein a fusible link is bonded across a pair of electrodes. A composite layer envelops the fusible link and is formed from a gelatinous composition. The composite layer and the fusible link are further encased within a molded housing. The gelatinous composition includes a nonconductive inorganic powder and a synthetic resin. The inorganic powder has a melting temperature below a fusion temperature of the fusible link. In an embodiment, the inorganic powder includes lead glass powder and alumina powder, and the synthetic resin is a low viscosity silicone resin. The inorganic powder is mixed with the silicone resin in a three to one ratio. Heat treatment dries the composite layer. The composite layer includes air pockets between particles of the inorganic powder elastically bound together by the synthetic resin. The air pockets support fusion combustion of the fusible link, contribute to the elasticity of the composite layer, and provide spaces for melted portions of said fusible link to flow into. The elasticity of the composite layer absorbs stresses thereby protecting the fusible link from damage. Melting of the fusible link concurrently melts the inorganic powder which flows into a gap created in the fusible link. The melted inorganic powder hardens forming an electrically insulating barrier between remaining portions of the fusible link. An alternate embodiment of the present invention interposes a flexible elastic film between the gelatinous composition and the housing which provides further stress absorption capacity.

5 Claims, 2 Drawing Sheets

OVERCURRENT PROTECTION DEVICE

This application is a continuation of pending application Ser. No. 08/410,139 filed Mar. 23, 1995 now abandoned, which in turn was a divisional application of application Ser. No. 08/235,287 filed Apr. 29, 1994, which issued as U.S. Pat. No. 5,572,181

BACKGROUND OF THE INVENTION

The present invention relates to an overcurrent protection element and, more particularly, to an overcurrent protection element having a geltype encapsulant providing improved mechanical reliability and fusing characteristics.

A conventional overcurrent protection element has a fusible link suspended in a flexible resin. The flexible resin is typically a silicone resin or the like. The conductive material and dimensions of the fusible link are selected to provide a predetermined current-responsive melting characteristic where the fusible link melts at a predetermined current level. Thus, when a current flowing through the fusible link reaches the predetermined level, the fusible link melts and the current flow is prevented, thereby protecting the circuits supplied through the fusible link.

Once a fusible link is melted, the overcurrent protection device ideally remains in an open-circuit state and is replaced after a problem producing the overcurrent condition has been corrected. However, the conventional overcurrent protection element described above is subject to a condition producing a residual conductive path through the overcurrent protection element after melting of the fusible link has occurred. The conductive path is formed by the burning of the flexible resin around a melting point of the fusible link. The flexible resin is carbonized and the carbon residue creates a conductive path which bypasses the melted portion of the fusible link and thus defeats the purpose of the overcurrent protection device.

Another type of overcurrent protection device eliminates the flexible resin in order to prevent the creation of a bypassing conductive path. The flexible resin is replaced by an inorganic powder which includes glass. The glass has a sufficiently low melting point so that the glass melts when the fusible link fuses. The melted glass covers the remaining portions of the fusible link, insulating and thereby preventing the formation of a bypassing conductive path.

The inorganic powder is friable and contains air pockets which support the combustion fusion of the fusible link. Furthermore, little or no carbide is produced. However, the inorganic powder encapsulation of the fusible link exhibits undesirable mechanical properties. Due to the friability of the inorganic powder, shocks encountered during manufacture, transportation, or installation or stresses resulting from thermal expansion can cause the inorganic powder to crumble away from the fusible link. The crumbling of the inorganic powder can also apply stress to the fusible link. The fusible link thus becomes subject to fracture as a result of stresses applied and the absence of cushioning.

OBJECTS AND SUMMARY OF THE INVENTION

Accordingly, it is an object of the invention to provide an overcurrent protection device which overcomes the drawbacks of the prior art.

In particular, it is an object of the present invention to provide an overcurrent protection device which is not subject to residual conductive paths and can reliably withstand stresses encountered during manufacture, transport, installation and use.

It is a further object of the invention to provide an encapsulating material capable of absorbing mechanical stresses encountered by a fusible link in an overcurrent protection device.

It is a still further object of the invention to provide an encapsulating material which fuses into an insulating coating on remnants of a fused fusible link.

It is yet another object of the invention to provide an encapsulating material which is elastic and has pockets of air which serve to support combustion of the fusible link and accept melted fusible link material.

Briefly stated, the present invention provides an overcurrent protection device and a method for the production thereof. The overcurrent protection device has a fusible link bonded across a pair of electrodes. A composite layer envelops the fusible link and is formed from a gelatinous composition. The composite layer and the fusible link are encased within a molded housing. The gelatinous composition includes a nonconductive inorganic powder mixed with a synthetic resin wherein the inorganic powder has a melting temperature below a fusion temperature of the fusible link. In one embodiment of the invention the inorganic powder includes lead glass powder and alumina powder, and the synthetic resin is a low viscosity silicone resin. Three parts of the inorganic powder are combined with one part of the silicone resin. The composite layer is dried by a heat treatment prior to molding the housing. The composite layer includes air pockets existing between particles of the inorganic powder elastically bound together by the synthetic resin. The air pockets support fusion combustion of the fusible link, contribute to the elasticity of the composite layer, and provide spaces for melted portions of said fusible link to flow into. The elastic characteristic of the composite layer absorbs stresses and thereby protects the fusible link from damage. The fusible link melts at a predetermined current level and concurrently melts the inorganic powder which then flows into a gap created in the fusible link. The melted inorganic powder hardens to provide an electrically insulating barrier between remaining portions of the fusible link. An alternate embodiment of the present invention interposes a flexible elastic film between the gelatinous composition and the housing which provides further stress absorption capacity.

In accordance with these and other objects of the invention, there is provided an overcurrent protection device comprising: first and second electrodes each having first and second end portions, a fusible link connecting the first end portions of the first and second electrodes, a gel composite having air pockets and encapsulating the fusible link and the first end portions, a housing encapsulating the gel composite, the fusible link, and the first end portions, and the second end portions extending outside the housing.

The present invention also provides an overcurrent protection device comprising: means for conducting a current from an input to an output, the means for conducting including a fusible portion for fusing at a predetermined current level, a composite layer enveloping the fusible portion, the composite layer including a nonconducting powder having a melting temperature below a melting temperature of the fusible portion, the composite layer including a means for elastically binding the nonconducting powder, a housing containing the composite layer and the fusible portion, and the housing having the input and the output exposed on an external surface thereof.

Further provided by the present invention is an overcurrent protection device comprising: means for conducting a current from an input to an output, the means for conducting having a fusible portion fusible at a predetermined current level, a composite layer enveloping the fusible portion, a flexible resin film layer covering the composite to provide shock absorption and stress relief, a housing containing the flexible resin film, the composite layer and the fusible portion; and the housing having the input and the output exposed external thereto.

According to a feature of the invention, the gel composite includes an inorganic powder having a melting point below a fusion temperature of the fusible link and further includes a resin. In an embodiment the resin is a liquid silicon resin and the inorganic powder includes lead glass powder and alumina powder.

Furthermore, the present invention provides a method of manufacturing an overcurrent protection device comprising the steps of: providing a conductor having a fusible portion, mixing a nonconductive powder with a resin to form a composite material where the nonconductive powder has a melting temperature below that of the fusible portion, enveloping the fusible portion in the composite material, heat treating the fusible portion enveloped in the composite material, and molding a housing around the fusible portion enveloped in the composite material.

The present invention further includes embodiments incorporating further features. For example, embodiments are presented wherein the step of heat treating includes baking the fusible portion enveloped in the composite material at a temperature of about 160° C. for about three hours. Additionally, the step of mixing includes mixing approximately three parts of the nonconductive powder with one part of the resin to form the composite material such that air pockets are formed in the composite material.

The above, and other objects, features and advantages of the present invention will become apparent from the following description read in conjunction with the accompanying drawings, in which like reference numerals designate the same devices.

DETAILED DESCRIPTION OF THE PREFERRED EMBODIMENT

Figure 1:
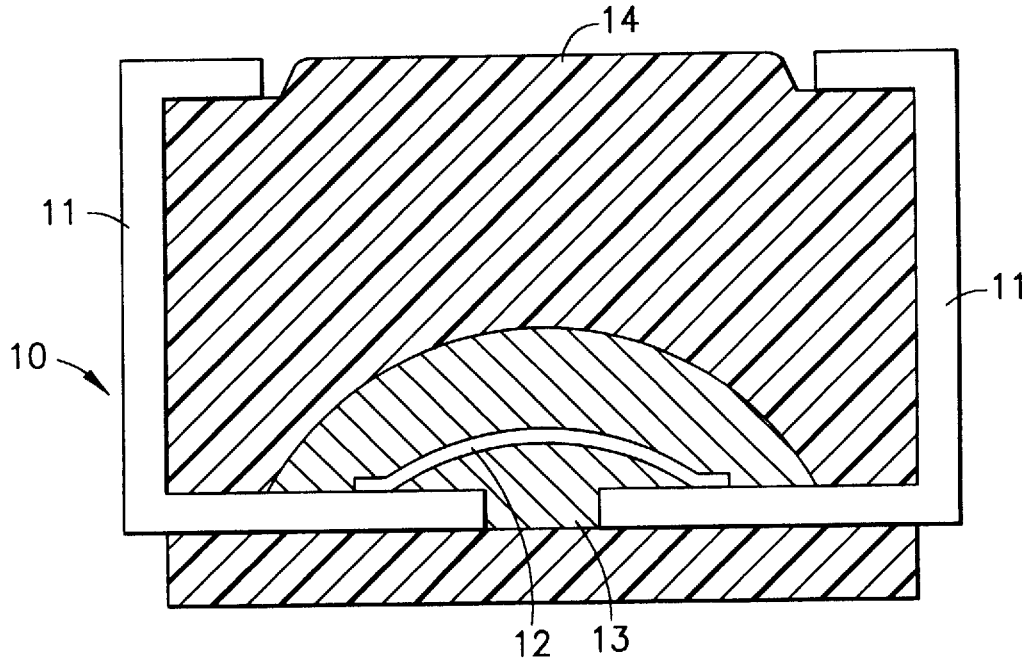
FIG. 1 PRIOR ART
FIG. 1 is a cross section drawing showing a prior art embodiment of an overcurrent protection device.

Referring to FIG. 1, there is shown an overcurrent protection device 10, of the prior art, having a fusible link 12 bonded across a pair of electrodes 11. The fusible link 12 is suspended in a flexible resin 13. The flexible resin 13 consists of a flexible silicone resin or a similar resin. A molded resin body 14 encapsulates the flexible resin 13 to fix the electrodes 11 in place.

The fusible link 12 is formed of a conductive material through which current passes. The conductive material and dimensions of the fusible link are chosen to provide for fusing of the fusible link 12 at a predetermined current level. In its desired mode of operation, upon fusing, a portion of the fusible link 12 is melted and or burned away producing an open circuit across the electrodes 11 and thus stopping the passage of excessive current. In actual use, however, the flexible resin 13, covering the fusible link 12, also burns and is carbonized. The carbon produced creates a residual current path due to its inherent conductive properties. The residual current path undermines the operation of the fusible link by permitting current to pass through remaining portions of the fusible link 12.

Figure 2:
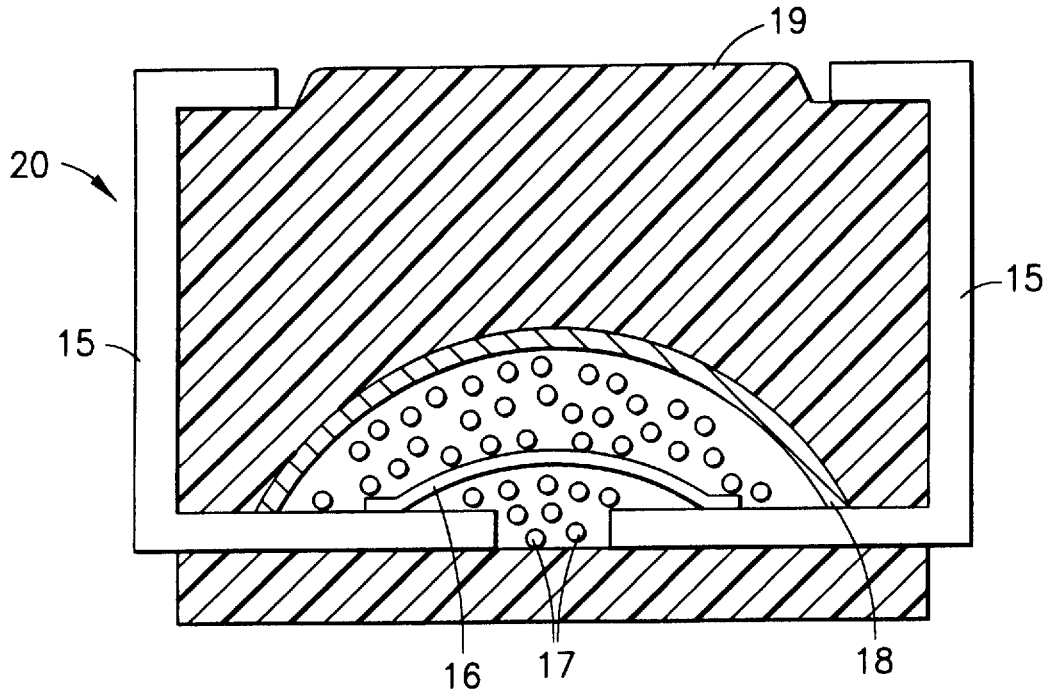
FIG. 2 PRIOR ART
FIG. 2 is a cross section drawing showing another prior art embodiment of an overcurrent protection device.

Referring to FIG. 2, another overcurrent protection device 20 of the prior art has a pair of electrodes 15 connected by a fusible link 16. The fusible link 16 is suspended in an inorganic powder 17 which includes a glass powder. A flexible synthetic resin 18, such as flexible silicone resin, covers the inorganic powder. A molded resin body 19 fixes the electrodes 15 in place and encapsulates the fusible link 16, inorganic powder 17, and flexible synthetic resin 18.

When the fusible link 16 fuses, the flexible synthetic resin 18 is far enough removed from the fusible link 16 to prevent burning and carbonization of the flexible resin 18. The glass powder has a low melting temperature so that melting and burning of the fusible link 16 also melts the glass powder. When the glass powder melts it covers and insulates remaining portions of the fusible link 16 thereby preventing the passage of current. The inorganic powder 17 inherently contains pockets of air. The pockets of air help to support combustion fusing of the fusible link 16. However, the pockets of air also impart a friability to the inorganic powder.

The friable nature of the inorganic powder 17 results in the inorganic powder 17 crumbling upon itself when shocks or stresses are applied to it. Shocks can occur through the life of the overcurrent protection devices as a result of manufacture, transportation, installation or general use of a device into which the overcurrent protection device 20 is installed. Stresses are also applied to the inorganic powder 17 by thermal expansion and contraction of the overcurrent protection device 20 during manufacture and installation. When the inorganic powder 17 crumbles, it falls away from the fusible link 16 removing support from the fusible link 16. Similarly, the inorganic powder 17 crumbles onto the fusible link 16 thereby adding stress to the fusible link. The combination of lack of support and added stress increases the possibility of fracture of the fusible link 16 and decreases the reliability of the overcurrent protection device 20.

Figure 3:
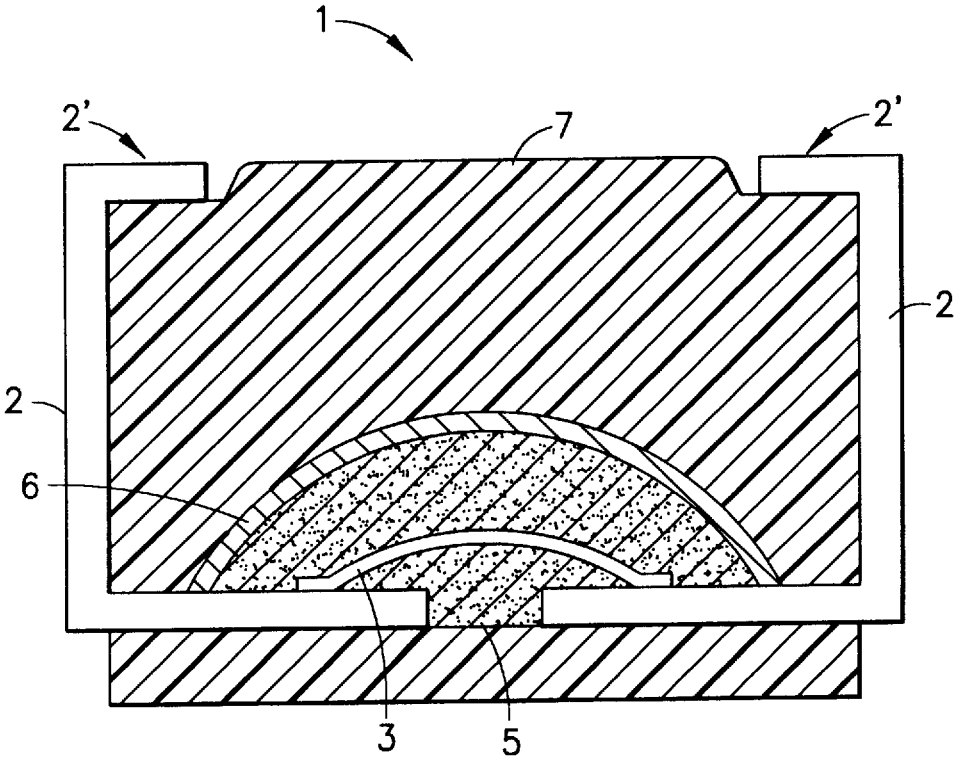
FIG. 3 is a cross section drawing showing an overcurrent protection device according to an embodiment of the present invention.

Referring to FIG. 3, an overcurrent protection device 1 of the present invention has electrodes 2 formed of a conductive metal and joined by a fusible link 3. The electrodes 2 are fixed relative to each other by a housing 7 formed from a molded resin. A composite layer 5 envelops the fusible link 3 and bonding areas of the electrodes 2. A synthetic resin layer 6 is interposed between the composite layer 5 and the housing 7 to cover the composite layer 5.

The fusible link 3 is bonded at bonding areas on the electrodes 2 in a stress relief arc configuration. The fusible link 3 is formed from a thin metal wire formed of aluminum (Al), however, other conductive materials including gold (Au), silver (Ag), and copper (Cu) can be used as alternatives. The size and composition of the fusible link 3 is chosen to produce a fusing temperature at a predetermined current level. Also, the conductive materials need not be pure metals. The conductive materials may also include alloys or metals including minute amounts of other elements. For example, in one embodiment of the present invention the aluminum wire includes a minute amount of silicon (Si), e.g. about 1%. The diameter of the aluminum wire is set at 10 $\mu$m~500 $\mu$m to provide a desired fusing current level. The aluminum wire is bonded to the electrodes 2 using ultra-sonic bonding techniques.

The composite layer 5 is formed from a composition material including an inorganic powder and a resin which forms a gelatinous composition. The inorganic powder is chosen to have a low melting point, below that of the fusing temperature of the aluminum wire. In the present example, the inorganic powder includes lead glass powder and alumina powder as the principle ingredients. The resin used in the present example is a synthetic resin, and in particular, a silicone resin (JIS-3181) having a low viscosity. Three parts of inorganic powder are mixed with one part silicone resin to form a gel which includes minute pockets of air for supporting fusing combustion of the fusible link 3. The silicone resin envelops individual inorganic compound particles connecting the particles in the gel. The above ratio may be varied to accommodate differing types of resins and particle sizes of the inorganic powder. Such variations are realizable by those skilled in the art having viewed this disclosure and are considered to be fully within the scope and spirit of the present invention.

In the present embodiment the synthetic resin layer 6 is gelatinous to form a resilient film-type barrier. However, synthetic resin layer 6 may also be a layer having a thickness thicker than that of a film. The synthetic resin layer 6 in the present embodiment is formed from a polyester resin. It is recognized that other materials may also be employed so long as the material forms a barrier layer capable of protecting the composite material. For instance, an epoxy resin or a silicone resin can be used. A primary requirement of the synthetic resin layer 6 is that it be formed from a material that is insoluble in the composite layer 5 to prevent the synthetic resin layer 6 from permeating into the air pockets of the composite layer 5. Additionally, the material of the synthetic resin layer 6 preferebly contains no solvents.

The electrodes 2, the fusible link 3, the composite layer 5, and the synthetic resin layer 6 are encased by the housing 7. In the present embodiment the housing 7 is formed from a thermosetting resin, such as an epoxy resin. However, other types of resins may be used including thermoplastic resins provided that they have sufficient heat resistant characteristics. A primary concern in the construction of electronic components is the ability of the component to withstand temperatures encountered in wave soldering operations used to install the component. The resins must be capable of withstanding at least 230° C. which is encountered in most soldering operations. If the resin has a deflection temperature below 230° C. the housing will distort and impart excessive stresses upon the fusible link 3.

The manufacturing process used to produce the overcurrent protection device 1 begins with the sonic bonding of the fusible link 3 across the electrodes 2 while the electrodes 2 are supported in a lead frame (not shown). The lead frame is a plate with opposing pairs of electrodes fixed apart a predetermined distance by a frame. Although plate shaped electrodes are used in the present embodiment, other configurations of electrodes may also be used, including posts. The predetermined distance spacing apart the electrodes 2, the bonding positions on the electrodes 2, and a length of the fusible link 3 are chosen to provide a sufficient stress relief arc in the fusible link 3.

After the fusible link 3 is bonded across the electrodes 2, the composite layer 5 is applied over the surfaces of the fusible link 2 and the bonding areas on the electrodes 2. The synthetic resin layer 6 is then applied over a surface of the composite layer 5 to form an insoluble barrier film. The lead frame, with the fusible link 3, electrodes 2, composite layer 5, and the synthetic resin layer 6 is then thermally treated to dry the composite layer 5 and the synthetic resin layer 6. In the present example, the thermal treatment consists of heating at 160° C. for three hours. Other embodiments of the present invention may require variations in the thermal treatments in accordance with the properties of the particular resins and inorganic powders employed.

The housing 7 is formed following the heat treatment. The lead frame is placed in a mold with the electrodes 2 extending through a wall of the mold and out of a mold cavity containing the fusible link 3, the composite layer 5, the synthetic resin layer 6 and the bonding portions of the electrodes 2. The mold cavity is then filled with a thermosetting resin. The synthetic resin layer 6 remains flexible to absorb stresses generated during injection molding and curing of the housing 7. The fusible link 3 and the composite layer 5 are thus protected from the stresses generated during molding.

Once the housing 7 has cured, the electrodes 2 are cut from the lead frame. The electrodes are then bent up along sides of the housing 7 and over a top surface of the housing 7 to form terminal areas 2' for surface mounting. The overcurrent protection device 1 is flipped over when mounted on a circuit board (not shown) such that the terminal areas 2' are placed in contact with solder pads (not shown) on the circuit board. The overcurrent protection device 1 is thus produced with a standard surfacemount configuration to permit installation manually or using automated placement machines. Alternatively, the electrodes 2 may be bent in a manner (not shown) such that the electrodes 2 extend from the top surface of the overcurrent protection device 1 to form terminal pins that are inserted into via holes in a circuit board. Other electrode configurations may be effected without departing from the scope and spirit of the present invention.

The overcurrent protection device 1 is subjected to various stresses during its life. Sources of stress include the above described molding operation, thermal expansion of the electrodes 2 due to heat encountered during soldering, mechanical stresses exerted by installation and soldering equipment engaging the electrodes 2, and mechanical shocks from transportation and handling. The synthetic resin layer 6 serves as a buffer barrier to absorb such stresses and protect the composite layer 5 and the fusible link 3. When stress is applied, the synthetic resin layer 6 elastically deforms to absorb the stress. Thus, survivability of the overcurrent protection device 1 during stress inducing operations is improved over that of the prior art.

The overcurrent protection device 1 is usually installed in a power distribution conductor, e.g., the power source line through which a heavy current flows, on a circuit board. The terminal areas 2' of the electrodes 2 are soldered to pads of the power distribution conductor. Current carried by the power distribution conductor thus passes through the electrodes 2 and the fusible link 3. When the current exceeds a predetermined value, resistance in the fusible link 3 produces a heat build-up. Due to the heat build-up, a temperature of the fusible link 3 exceeds a fusing temperature of the fusible link 3. When the fusing temperature is exceeded, thermal fusion takes place and the fusible link melts and or burns.

Heat from the thermal fusion melts the inorganic powder 5, and in particular, the lead glass powder used in the present embodiment. The melted lead glass powder flows onto remaining portions of the fusible link 3 and into a gap formed between the remaining portions of the fusible link 3. The melted lead glass powder solidifies to form an insulating barrier between the remaining portions of the fusible link 3.

The melted material of the fusible link 3 flows away from the gap and into the air pockets formed between the particles of inorganic powder of the composite layer 5. The melted fusible link material also flows into spaces created by the melting of the inorganic powder.

The thermal fusion also burns a small amount of the silicone resin in the composite layer 5. However, carbonization resulting from the combustion of the silicone resin is minute due to the reduced amount of silicone resin in the composite layer 5 and the limiting of the combustion to the area where the melting of the inorganic powder takes place. As stated above, in the present example, there are three parts inorganic powder to one part silicone resin. The silicone resin covers the inorganic powder particles in amounts sufficient to bind the inorganic powder particle into a gel wherein air gaps are left between particles. Thus, the amount of silicone resin burned is far reduced from an amount burned in the prior art of FIG. 1.

The combination of the melting of the inorganic powder to form an insulating covering, and the reduced amount of carbonization, ensures that the overcurrent protection device 1 becomes open-circuited after the predetermined current level is exceeded. Furthermore, the open-circuit condition is reliably maintained after the fusible link 3 has melted. The occurrence of residual current paths is therefore prevented.

An alternative embodiment of the present invention eliminates the synthetic resin layer 6 forming the buffer. The gelatinous nature of the composite layer 5 ensures adequate protection of the fusible link 3 by absorbing the shock and stresses described above.

The embodiments of the present invention described above provide a reliable means for protecting circuits from excessive current levels. The binding of the inorganic powder by the resin facilitates the formation of the air pockets in the composite layer 5 which produces the elasticity required for absorbing stress. Covering the fusible link 3 and the bonding areas of the electrodes 2 with the composition material 5 provides a shock absorbing region capable of elastic deformation which protects the fusible link 3. Therefore, the reliability of the overcurrent protection device is improved.

The air pockets in the composition material 5 serve several other functions besides providing elasticity. The air pockets provide oxygen for ensuring fusion combustion of the fusible link 2. The air pockets also provide spaces for melted fusible link material to flow into and away from a gap in the fusible link 3 created by the combustion fusion. Furthermore, the air pockets reduce the amount of resin burned and the resultant carbonization. The effects of reduced carbonization and the inorganic powder melting into the gap and onto remaining portions of the fusible link 3 ensure a reliable open-circuit condition after the fusion of the fusible link 3.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method of manufacturing an overcurrent protection device comprising the steps of:

providing a conductor having a fusible portion and first and second ends;

mixing approximately three parts of a nonconductive powder with one part of a resin to form a composite material where said nonconductive powder has a melting temperature below that of said fusible portion, and particles of said nonconductive powder are elastically bound by said resin;

said step of mixing including mixing said nonconductive powder with said resin at a ratio such that said composite material is effective to prevent carbonization of said resin, whereby formation of a residual conductive path through said conductor is avoided after melting of said conductor has occurred;

forming air pockets between said particles of said nonconductive powder in said resin;

enveloping said fusible portion in said composite material;

heat treating said fusible portion enveloped in said composite material; and molding a housing around said fusible portion, enveloped in said composite material, after said step of heat treating, while leaving said first and second ends exposed.

2. The method according to claim 1 wherein said nonconductive powder includes a glass powder.

3. The method according to claim 1 wherein said step of heat treating includes baking said fusible portion enveloped in said composite material at a temperature of about 160° C. for about three hours.

4. The method according to claim 1 further comprising applying a flexible resin layer over said composite material after said fusible portion is enveloped in said composite material and before said step of heat treating.

5. A method of manufacturing an overcurrent protection device comprising the steps of:

providing a conductor having a fusible portion and first and second ends;

mixing approximately three parts of a nonconductive powder with one part of a resin to form a composite material such that air pockets are formed in said composite material, particles of said nonconductive powder are elastically bound by said resin, and said nonconductive powder has a melting temperature below that of said fusible portion;

said step of mixing including mixing said nonconductive powder with said resin at a ratio such that said composite material is effective to prevent carbonization of said resin, whereby formation of a residual conductive path through said conductor is avoided after melting of said conductor has occurred;

enveloping said fusible portion in said composite material;

heat treating said fusible portion enveloped in said composite material, said step of heat treating including baking said fusible portion enveloped in said composite material at a temperature of about 160° C. for about three hours;

applying a flexible resin layer over said composite material after said fusible portion is enveloped in said composite material and before the step of heat treating; and molding a housing around said fusible portion, enveloped in said composite material, after the step of heat treating, while leaving said first and second ends exposed.

* * * * *